US008091558B2

(12) United States Patent
Martzel

(10) Patent No.: US 8,091,558 B2
(45) Date of Patent: Jan. 10, 2012

(54) CIGARETTE SUBSTITUTE

(75) Inventor: Didier Gerard Martzel, Bining (FR)

(73) Assignee: Gaiatrend Sarl, Rohrbach les Bitche (FR)

( * ) Notice: Subject to any disclaimer, the term of this patent is extended or adjusted under 35 U.S.C. 154(b) by 860 days.

(21) Appl. No.: 12/159,902

(22) PCT Filed: Dec. 22, 2006

(86) PCT No.: PCT/EP2006/700155

§ 371 (c)(1),
(2), (4) Date: Jul. 2, 2008

(87) PCT Pub. No.: WO2007/077167

PCT Pub. Date: Jul. 12, 2007

(65) Prior Publication Data

US 2008/0276947 A1 Nov. 13, 2008

(30) Foreign Application Priority Data

Jan. 3, 2006 (FR) ..... 06 50008

(51) Int. Cl.
*A24F 47/00* (2006.01)

(52) U.S. Cl. ..... 131/273; 131/270; 131/271

(58) Field of Classification Search ..... None
See application file for complete search history.

(56) References Cited

U.S. PATENT DOCUMENTS

| | | | |
|---|---|---|---|
| 4,574,181 | A | 3/1986 | Spector |
| 4,945,931 | A | 8/1990 | Gori |
| 2003/0075188 | A1 | 4/2003 | Adiga et al. |
| 2003/0226837 | A1 | 12/2003 | Blake et al. |
| 2005/0016549 | A1 | 1/2005 | Banerjee et al. |

FOREIGN PATENT DOCUMENTS

| | | | |
|---|---|---|---|
| DE | 19854005 | A1 | 5/2000 |
| DE | 19935706 | A1 | 2/2001 |
| EP | 0430559 | A2 | 6/1991 |
| EP | 0 444 553 | A2 | 9/1991 |
| EP | 0444553 | A | 9/1991 |
| EP | 0503767 | A1 | 9/1992 |

OTHER PUBLICATIONS

International Search Report of PCT/EP2006/070155; date of mailing May 15, 2007.

*Primary Examiner* — Richard Crispino
*Assistant Examiner* — Michael J Felton
(74) *Attorney, Agent, or Firm* — Westerman, Hattori, Daniels & Adrian, LLP

(57) ABSTRACT

The invention relates to a cigarette substitute, comprising a hollow tubular element (1) provided with a generator of products to be inhaled (7, 8), with internal heating means (6) for heating the inspired air or at least part of the generator of products to be inhaled, and with a device (8) for triggering the generator of products to be inhaled. It is characterized in that the triggering device comprises an element (8) sensitive to the heat produced by heating means that are situated outside the substitute (1) and are independent of the latter, said heat-sensitive element (8) being made of a material that cannot ignite or burn under the conditions of normal use of the substitute (1). It is thus possible to activate the cigarette substitute with the aid of a flame, without thereby causing combustion of the generator of products to be inhaled.

20 Claims, 1 Drawing Sheet

CIGARETTE SUBSTITUTE

Figure 1:
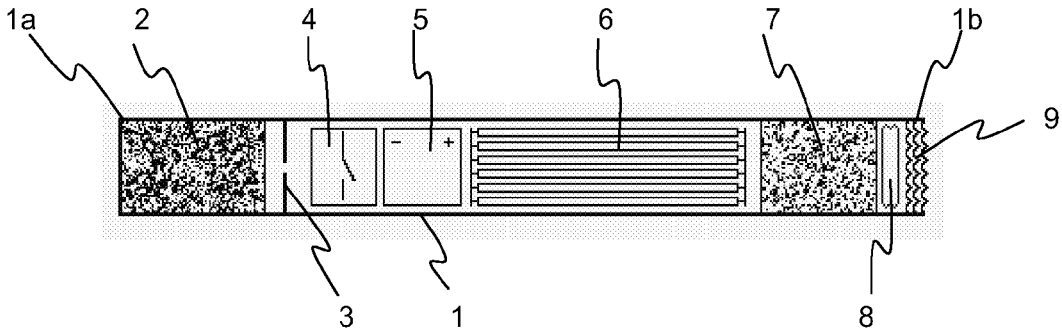

The invention relates to a cigarette substitute, comprising a hollow tubular element equipped with a generator of inhalable products, internal heating means for heating the air drawn in or at least part of the generator of inhalable products, and a device for activating the generator of inhalable products.

People who want to stop smoking have an arsenal of medical and non-medical aids available to them. In order to stop smoking, one must not only break the nicotine habit, but also get out of the habit of lighting a cigarette. These two factors are the main source of failure in smoking cessation treatments.

For this purpose, various cigarette substitutes have been proposed that, while simulating the motions of smoking a cigarette, do not release the toxic substances found in real cigarettes, such as tar. Depending on the design, these substitutes release only nicotine or only an odorant and/or flavoring agent, or both.

An imitation cigarette is known from WO 2005/009152 A, consisting of a cylindrical body made of plastic material in which there is a plug at one end allowing ambient air to pass through, natural essences positioned between two filters, and a mouthpiece. This imitation cigarette thus discharges only natural essence fragrances.

From WO 2005/099494 A, a nicotine aerosol electronic cigarette is known, comprising, in a shell, an electronic circuit board, a constant pressure cavity, a sensor, a gas-liquid separator, an atomizer and a supply bottle, the electronic circuit board consisting of an electronic switching circuit and a high frequency generator. This electronic cigarette releases a dose of nicotine to the smoker.

These two cigarette substitutes release a cold puff of natural essences or nicotine to the smoker, producing sensations far from those he normally has when smoking a real cigarette.

Thus, cigarette substitutes have been proposed in which the air drawn in is heated, either directly or through the generator of inhalable products. In all cases, the user inhales a puff of heated air suffused with the product to be inhaled.

An example of the first embodiment is disclosed in DE 199 35 706 A1. It describes a cigarette comprising an incandescent wire, a battery, a switch activated by inhalation, a nicotine-soaked filter, and an optional aromatic agent (menthol), arranged one behind the other. The air drawn in is heated by the incandescent wire, then passes through the filter, where it is suffused with nicotine. This cigarette thus provides nicotine-rich warm air. A similar device is found in document DE 297 13 866 U1.

In document U.S. Pat. No. 4,945,931 A, a valve activated by inhalation triggers aerosol release of a spray contained in a pressurized vial. This aerosol, mixed with air drawn in simultaneously, is heated by an electrical resistor before being inhaled.

Numerous documents propose the second solution. For example, document EP 0 430 559 A2 discloses a device that produces an aroma in which the aroma generator is in direct contact with a heating resistor. The heat produced by the heating resistor causes the aroma generator to release its substance(s), which are then inhaled by the user. A similar device is disclosed in document EP 0 503 767 A1.

Document DE 198 54 005 A1 proposes a cigarette substitute in which a material capable of generating an aerosol is surrounded by an electrical resistor. By pushing on a button or using a control device, the resistor is heated and air is drawn in through the aerosol-releasing material before being inhaled.

Document EP 0 845 220 A1 discloses an aroma-producing item. In this item, the aromatic substance is placed in a reservoir equipped with a channel directing the liquid toward outlet ports. The heat causes the liquid placed in the outlet ports to vaporize before being inhaled by the user. The reservoir is removable and can be replaced. This device is particularly complicated and costly.

Various means of controlling the heating device have been proposed. A first solution consists in providing a switch that closes the electrical circuit when it is pressed (EP 0 845 220 A1, DE 297 13 866 U1, DE 198 54 005 A1). Other devices are designed to begin heating upon inhalation, e.g., by using a valve that is displaced by the air drawn in. When air is drawn in, this valve is displaced, causing the heating circuit to close (DE 199 35 706 A1, U.S. Pat. No. 4,945,931). Lastly, other systems provide a complete electronic circuit that controls the length of time and the degree to which the air or the substrate is heated; heating is activated by pressing on a switch (see EP 0 430 559 A2, EP 0 503 767 A1).

In all of these examples, the user experiences the sensation of inhaling a puff of air enriched with various products, close to what he is used to inhaling from a real cigarette. However, the motions of lighting a cigarette are missing. This motion is an important element in the smoker's ritual and its absence is one of the reasons that traditional withdrawal measures fail. This is why some documents have proposed heating means that are lit with a flame first, and are then consumed without giving off smoke.

This is the case in document EP 1 600 066 A2, which discloses a smoking device that serves as an aerosol for a flavoring agent. It has the shape of a cigarette, with a balsa core for a fuel source, surrounded by a high proportion of non-combustible mineral material impregnated with the flavoring agent, the whole contained in a non-combustible envelope closed off at one end with a traditional filter. The envelope and the non-combustible mineral material create cinders as they are consumed, which the smoker can let fall as he is accustomed to doing. In this case, it is conceivable that the puff inhaled by the smoker is heated due to the combustion of the balsa core. However, this puff contains not only high levels of aerosol, but also combustion products, which can be harmful.

In the same category of smoking devices, a cigarette substitute is known from document EP 1 468 618 A that includes a hollow cylindrical element equipped with a heat generator at one end and a mouthpiece at the other end. A flavor generator, comprising a plurality of pellets containing flavor-yielding substances, is placed near the heat generator. Another flavor-generating device is placed at a distance from the first one for the substances that do not require heating. In this smoking device, the heat generator is largely composed of carbon. Thus, the heat generator must be ignited so that it burns up while providing heat. Channels have been provided inside the heat generator to allow air to pass through it without coming into contact with the burning material. Here again, the cigarette gives off combustion products of the material that makes up the heat generator.

In these two documents, the cigarette substitute is activated by lighting a combustible product with a flame; the combustible product, as it burns, then heats either the air drawn in or the substrate producing the aerosol. The flame thus triggers a combustion process that continues for the entire time the substitute is being used. Even though in some cases the combustion products are not directly inhaled, they are still given off in the immediate surroundings of the smoker and his environment, which greatly reduces the advantages of such substitutes.

The object of the invention is thus to propose a cigarette substitute that provides the smoker with a puff of warm air enriched with an odorant or flavoring product, and that requires the use of a lighter or a match to activate it, without thereby causing the combustion of any product.

This objective is achieved by the invention due to the fact that the triggering device comprises an element that is sensitive to a heat input produced by heating means located outside the substitute and independent of it, with said heat-input sensitive element being made of a material that cannot be ignited or burned under the normal usage conditions of the substitute. As long as no external heat has been applied to the element sensitive to external heat input, the cigarette substitute cannot work properly, and no aerosol containing the flavoring products or odorants or any other product to be inhaled can be generated. This cigarette substitute allows the smoker to retain the ritual of lighting up with the lighter or match flame. However, this external-heat-sensitive element does not ignite and does not burn. Consequently, it does not give off any undesirable product.

In a preferred embodiment of the invention, the cigarette substitute additionally comprises means for activating the internal heating means only when this heat-sensitive element has been exposed to heat generated by external heating means. In this way, one can avoid needlessly activating these internal heating means before the aerosol can be produced.

In a first embodiment of the invention, the triggering device is a heat detector, preferably a bimetallic element, that is electrically connected to the internal heating means. In this way, when the heat detector confirms the application of external heat, it sends a signal to the internal heating means, which can then turn on.

In a second embodiment of the invention, the generator of inhalable products comprises a reservoir that is preferably interchangeable. This makes it possible to reuse the cigarette substitute and to choose between several flavoring products or odorants.

In a particularly advantageous embodiment, the reservoir is made of a material that can be at least partially destroyed by heating means without igniting or burning, preferably by melting or through tearing means, and the generator of inhalable products is equipped with means for absorbing the contents of the reservoir when the latter is at least partially destroyed.

These reservoir heating means can consist of the external heating means. Thus, the heat applied by the flame serves to partially melt the reservoir, thereby releasing its contents into the absorption means, which can consist of a plug, preferably made of a fabric and preferably interchangeable.

The heating means for the reservoir can also be embodied in the form of a heating resistor connected to an electrical energy source and controlled by the heat-sensitive element. This way, the heat provided by the flame is detected by the external-heat-sensitive element, which then turns on the electrical resistor that heats the reservoir. This electrical resistor can be included in the reservoir itself or it can be a component of the cigarette substitute.

It is preferable to place the reservoir at the end of the tubular element opposite the end meant to be placed in the mouth.

In order to heat the air when the smoker draws on the cigarette substitute, starting means are provided for turning the electrical heating element on and off, the starting means preferably being equipped with first means for activating at least part of the electrical heating element upon inhalation and for deactivating it when inhalation ends. In this way, it is possible to conserve the electrical energy source by providing full heat only when the smoker inhales a puff. This also keeps the heating element from being too hot when the next puff is taken.

Furthermore, in order to provide practically instantaneous heating, the starting means can also be equipped with second means for activating at least part of the electrical heating element after the first inhalation without deactivating it when inhalation ends. This way, once the heating element is turned on at the first puff, part of the heating element remains on, providing a "base heat level", as in a real cigarette. The air contained in the cigarette substitute is thus heated, and the following puff is warm from the beginning. Upon each puff, the rest of the heating element is activated, thereby increasing the warmth of the air drawn in, as a real cigarette would, due to the influx of oxygen from inhalation.

In a preferred embodiment of the invention, the first and/or the second means for activating the heating element comprise a contact switch. This contact switch can be equipped with a light return spring and a disk through which air can pass, for example, with the spring and the disk arranged so that the disk closes an electrical circuit during an inhalation and opens this circuit by the action of the return spring when inhalation stops. The very act of inhaling air through the substitute brings in a flow of air that pushes the disk up against a metal plate, closing the circuit. As soon as inhalation ends, the spring brings the disk back and thereby breaks the circuit.

It is preferable for the cigarette substitute to have an autonomous electrical energy source, preferably an electric battery or capacitor.

It can be helpful to provide the cigarette substitute with an air speed regulator, preferably in the form of a perforated disk.

In addition, it can be helpful to provide the tubular element with a filter at the end meant to be placed in the mouth, preferably a filter imitating that of a real cigarette. Likewise, it can be advantageous to provide luminous means at the end of the tubular element opposite the end meant to be placed in the mouth, to simulate the cigarette's incandescence, in particular in the form of intermingled heating resistors connectable to the electrical energy source, preferably through the starting means; the luminous means can have an opening to provide access to the inside of the tubular element.

So that the smoker can experience all the pleasures of a real cigarette, a smoke generator can be provided, in particular, an electric smoke generator connectable to the energy source, preferably via the starting means. This would be done so that the smoke is not released into the smoker's mouth.

The invention is explained in more detail below using the single figure, which shows an example of embodiment.

The cigarette substitute comprises a hollow tubular element (1) closed off at one of its ends (1*a*) by a filter (2) and at its other end (1*b*) by luminous means (9) simulating a cigarette's incandescence.

Behind the filter (2), there is an air speed regulator (3). The latter can be made from a perforated disk. The diameter of the perforation is calculated so as to provide a brake against the stream of air equivalent to the inhalation resistance of a real cigarette.

Next, there is a contact switch (4), e.g., made of a perforated disk that pivots between an open resting position away from the contact plate and a closed position in which it is held against the contact plate. A return spring not shown directs it back to the open resting position. When the smoker inhales a puff through the tubular element, the airflow causes the perforated disk to close, and thus closes the contact switch (4). As soon as the airflow from inhalation stops, the spring takes the disk back to its open resting position.

The tubular element (1) also contains a heat generator (6), preferably made up of heating resistors. Part of the heat generator (6) is intended to be on only when the smoker inhales air through the cigarette substitute, while the rest must remain on even between two successive puffs. For this purpose, the starting means of the heating element comprise an electronic circuit not shown that controls these two parts. In another alternative embodiment, the contact switch (4) can be provided with a double contact, with the first contact reacting to inhalations, while the second, once it is closed by the first inhalation, is kept in this position even when inhalation stops. The heat generator (6) is supplied with electrical energy by an electric battery (5).

The flavoring agents and/or odorants are absorbed on a plug (7). These agents are designed to be initially contained in a reservoir (8) placed near the plug (7). When the cigarette substitute is "lit" with the lighter flame, the heat applied is transmitted to the reservoir (8), which is at least partially destroyed by melting. The contents of the reservoir (8) are put in contact with the plug (7), which absorbs them. In the embodiment example presented here, the reservoir (8) is a capsule enveloped in a material with a fairly low melting point. The products to be inhaled can also be manually applied to the plug (7), e.g. using a pipette. For this purpose, an access orifice would be provided, e.g., in the luminous means (9) that close off the "incandescent" end of the cigarette substitute.

In the case where a reservoir is used, its size can be such that it can obstruct the inside of the hollow tubular element (1), the end of which can be metallic. An external heat source like a lighter flame then makes it possible to melt the capsule's envelope and release the liquid, which will then be absorbed by capillary attraction.

The reservoir can also be surrounded by a heating resistor connected to the battery via the contact switch (4) and optionally via the electronic control circuit. During the first inhalation, once the substitute has been activated by the lighter flame, detected by a detector not shown, the heating resistor at least partially melts the capsule's envelope, releasing its contents, which are absorbed by the plug (7). In another variant, the heating resistor is activated directly by the external heat detector. The heating resistor can be integrated with the reservoir or be placed around it when it is inserted into the tubular element (1).

The exact order of the various components can vary according to the space they occupy and the desired effects. In particular, multiple reservoirs can be provided, some of which are placed upstream from the heating element in order to heat their contents during inhalation, and others are placed downstream so that their contents do not pass through the heating element.

As a nonlimiting example, the tube will have the dimensions of a cigarette. The discharge time for the energy source can be approximately 5 minutes.

Although it is not shown in the example in FIG. 1, a smoke generator can also be provided.

The cigarette substitute of the invention operates in the following way. First of all, the user must activate the flavor or odor generator by applying an external heat source to the substitute. The simplest way is to use a lighter flame or a match. The element sensitive to this external heat is then activated. In the example presented here, the heat at least partially melts the reservoir (8), releasing its contents onto the plug (7). As long as this action has not taken place, the flavoring product or odorant remains enclosed in the reservoir (8), and the odor and/or flavoring generator is not turned on. As mentioned previously, a heat detector could have been provided that would have closed a control circuit. This would have switched on the heating resistor located around or in the reservoir (8), causing it to partially melt. Another alternative would have been to provide a heat detector, e.g., a bimetallic element that would have given a signal to the control circuit. The control circuit would have then switched to the operating position, allowing the internal heating means (6) to be used, or caused the reservoir to melt during the first inhalation. The bimetallic element could also be designed in such a way that it tears up the reservoir after being deformed by the heat of the flame.

Once the cigarette substitute is thus activated, inhaling air through the mouthpiece (1*a*) is all that is required to cause the internal heating means (6) to turn on. The first time it is used, the contact switch (4) closes, causing the heating element (6) to turn on, for one, but also making the filaments of the luminous means (9) incandescent, and if applicable, turning on the resistor located on the reservoir, causing the release of its contents, which are then absorbed by the plug (7). The air drawn in enters through the luminous means, passes through the plug (7) while being suffused with flavoring and/or odor agents, and then this rich air passes through the heating element (6), where it is heated. Then it passes through the orifices of the contact switch (4) disk and those of the speed regulator (3) before going through the filter (2) and reaching the smoker's mouth.

When inhalation stops, the contact switch (4) reopens by the action of the spring, or if the contact switch is a dual one, one of the contact switches opens and the other remains closed. Due to the contact switch (4) or one of the contact switches opening, part of the heating element is no longer powered, as well as at least part of the filaments of the luminous means (9), whereas the other part of the heating element (6) and of the luminous means (9), if applicable, still receive power owing to the second contact switch remaining closed or to an electronic control circuit. This way, the air contained in the tubular element remains warm without overheating, and the end simulating combustion remains slightly incandescent. The following inhalation again causes the contact switch (4) to close completely, thereby energizing the entire heating element and all of the filaments of the luminous means.

There is thus a very great resemblance in use and appearance between the cigarette substitute of the invention and a real cigarette. The smoker retains the ritual and the heat and taste/odor sensations he had with a real cigarette, but without having the disadvantages.

The triggering device according to the invention can be applied to all of the cigarette substitutes known to the state of the art, the inventive principle being to require activation using a lighter or a match before the substitute can be used.

LIST OF REFERENCES

1 Hollow tubular element
1*a* End meant to go in the mouth
1*b* "Incandescent" end
2 Filter
3 Air speed regulator
4 Contact switch
5 Electrical energy source
6 Electrical heating element
7 Plug
8 Reservoir
9 Luminous means

The invention claimed is:

1. Cigarette substitute comprising:

a hollow tubular element equipped with a generator of inhalable products, internal heating means for heating the air drawn in or at least part of the generator of inhalable products, and a triggering device for activating the generator of inhalable products, wherein the triggering device comprises a heat sensitive element that is sensitive to a heat input produced by application of external heat produced outside the substitute and independent of it, with said heat sensitive element being made of a material that cannot be ignited or burned under the normal usage conditions of the substitute.

2. Cigarette substitute according to claim 1, wherein the internal heating means is activated only when the heat sensitive element has been exposed to externally generated heat.

3. Cigarette substitute according to claim 1, wherein the triggering device is a heat detector, preferably a bimetallic element, that is electrically connected to the internal heating means.

4. Cigarette substitute according to claim 1, wherein the generator of inhalable products comprises a reservoir.

5. Cigarette substitute according to claim 4, wherein the reservoir is placed at the end of the tubular element opposite the end meant to be placed in the mouth.

6. Cigarette substitute according to claim 4, wherein the reservoir is made of a material that can be at least partially destroyed by the internal heating means or external heat without igniting or burning, and the generator of inhalable products is equipped with a material for absorbing the contents of the reservoir when the latter is at least partially destroyed.

7. Cigarette substitute according to claim 6, wherein the internal heating means comprises reservoir heating means are made of a heating resistor connected to an electrical energy source and controlled by the heat-sensitive element.

8. Cigarette substitute according to claim 6, wherein the material for absorbing the contents of the reservoir absorption means consists of a plug.

9. Cigarette substitute according to claim 1, wherein the internal heating means are made of an electrical heating element.

10. Cigarette substitute according to claim 9, which comprises starting means for turning the electrical heating element on and off, the starting means being equipped with first means for activating at least part of the electrical heating element upon inhalation and for deactivating it when inhalation ends.

11. Cigarette substitute according to claim 10, wherein the starting means are equipped with second means for activating at least part of the internal heating element after the first inhalation without deactivating it when inhalation ends.

12. Cigarette substitute according to claim 11, wherein the first and/or the second means for activating the internal heating element comprise a contact switch equipped with a light return spring and a disk through which air can pass, with the spring and the disk arranged so that the disk closes an electrical circuit during an inhalation and opens this circuit by the action of the return spring when inhalation stops.

13. Cigarette substitute according to claim 1, which comprises an autonomous electrical energy source, preferably a battery or a capacitor.

14. Cigarette substitute according to claim 1, which is equipped with an air speed regulator.

15. Cigarette substitute according to claim 1, wherein the tubular element is provided with a filter at the end meant to be placed in the mouth.

16. Cigarette substitute according to claim 1, wherein the tubular element is provided with a luminous element simulating a cigarette's incandescence at the end opposite the end meant to be placed in the mouth, wherein the luminous element can have an opening to provide access to the inside of the tubular element.

17. Cigarette substitute according to claim 1, which is equipped with a smoke generator.

18. Cigarette substitute according to claim 4, wherein the reservoir is interchangeable.

19. Cigarette substitute according to claim 6, wherein the reservoir is made of a material that can be at least partially destroyed by the internal heating means by melting or through tearing.

20. Cigarette substitute according to claim 9, which comprises starting means for turning the electrical heating element on and off.

* * * * *